US010550610B2

(12) United States Patent
Linden et al.

(10) Patent No.: US 10,550,610 B2
(45) Date of Patent: Feb. 4, 2020

(54) INSIDE OVERRIDE EMERGENCY HANDLE FOR DOOR RELEASE

(71) Applicant: FORD GLOBAL TECHNOLOGIES, LLC, Dearborn, MI (US)

(72) Inventors: Howard Paul Tsvi Linden, Southfield, MI (US); Constantin Manolescu, Rochester Hills, MI (US); Kostandinos D. Papanikolaou, Huntington Woods, MI (US); Christopher Matthew Radjewski, Macomb Township, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 733 days.

(21) Appl. No.: 15/189,405

(22) Filed: Jun. 22, 2016

(65) Prior Publication Data

US 2017/0370133 A1 Dec. 28, 2017

(51) Int. Cl.
*E05B 81/90* (2014.01)
*E05B 85/12* (2014.01)
(Continued)

(52) U.S. Cl.
CPC ..... *E05B 81/90* (2013.01); *E05B 79/06* (2013.01); *E05B 79/20* (2013.01); *E05B 85/12* (2013.01);
(Continued)

(58) Field of Classification Search
CPC ..... E05B 81/90; E05B 79/06; E05B 79/20; E05B 85/12; E05B 7/00; Y10T 292/57;
(Continued)

(56) References Cited

U.S. PATENT DOCUMENTS 3,479,767 A 11/1969 Gardner et al.
4,038,718 A * 8/1977 Reilhac ..... E05B 85/12 292/336.3
(Continued)

FOREIGN PATENT DOCUMENTS

CN 101932466 12/2010
CN 103206117 7/2013
(Continued)

OTHER PUBLICATIONS

Kistler Instruments, "Force Sensors Ensure Car Door Latch is Within Specification," Article, Jan. 1, 2005, 3 pages.

*Primary Examiner* — Kristina R Fulton
*Assistant Examiner* — Faria F Ahmad
(74) *Attorney, Agent, or Firm* — Vichit Chea; Price Heneveld LLP

(57) ABSTRACT

A motor vehicle emergency handle door release comprises a housing having a pair of opposed walls and one of a pair of opposed pivot bosses disposed on an interior surface of each of the opposed walls. A pivotable handle comprises a pivot mount, a lever disposed on one side of the pivot mount, and a door latch release cable end fitting disposed on another side of the pivot mount. The pivot mount includes a pair of opposed pivots extending laterally from the pivot mount of the pivotable handle that are received within the pivot bosses disposed on the interior surface of each of the opposed walls. A spring having a first leg is disposed against a surface of the housing and a second leg is disposed against a surface of the pivotable handle, urging the pivotable handle to a stowed position.

17 Claims, 8 Drawing Sheets

(51) Int. Cl.
*E05B 79/06* (2014.01)
*E05B 79/20* (2014.01)

(52) U.S. Cl.
CPC .... *Y10T 292/0908* (2015.04); *Y10T 292/0914* (2015.04); *Y10T 292/57* (2015.04)

(58) Field of Classification Search
CPC ..... Y10T 292/0908; Y10T 292/091; Y10T 292/82
USPC ..... 292/336.3, 92, 110, DIG. 30, DIG. 31, 292/DIG. 65, 347
See application file for complete search history.

(56) References Cited

U.S. PATENT DOCUMENTS 4,457,148 A 7/1984 Johansson
4,580,822 A * 4/1986 Fukumoto ..... E05B 85/12 16/266
4,672,348 A 6/1987 Duve
4,674,781 A 6/1987 Reece et al.
4,702,117 A 10/1987 Tsutsumi et al.
4,848,031 A 6/1989 Yamagishi et al.
4,858,973 A * 8/1989 Ogasawara ..... E05B 85/12 292/347
4,929,007 A 5/1990 Bartczak et al.
5,011,202 A * 4/1991 Kato ..... B41J 3/54 292/336.3
5,129,694 A * 7/1992 Tanimoto ..... E05B 1/0061 29/437
5,263,750 A * 11/1993 Smith ..... E05B 85/12 292/336.3
5,277,080 A * 1/1994 Roelle ..... A47C 1/024 56/10.5
5,292,159 A * 3/1994 Sandhu ..... E05B 15/1635 292/173
5,618,068 A 4/1997 Mitsui et al.
5,632,515 A 5/1997 Dowling
5,644,869 A 7/1997 Buchanan, Jr.
5,651,163 A * 7/1997 Tamaki ..... E05B 85/18 292/336.3
5,653,484 A 8/1997 Brackmann et al.
5,794,994 A * 8/1998 Miyagawa ..... E05B 85/12 292/336.3
5,802,894 A 9/1998 Jahrsetz et al.
5,895,081 A * 4/1999 Tanimoto ..... E05B 85/12 292/336.3
5,896,768 A 4/1999 Cranick et al.
5,901,991 A 5/1999 Hugel et al.
5,921,612 A 7/1999 Mizuki et al.
5,992,194 A 11/1999 Baukholt et al.
6,000,257 A 12/1999 Thomas
6,042,159 A 3/2000 Spitzley et al.
6,050,117 A 4/2000 Weyerstall
6,065,316 A 5/2000 Sato et al.
6,075,294 A 6/2000 Van den Boom et al.
6,099,048 A 8/2000 Salmon et al.
6,125,583 A 10/2000 Murray et al.
6,152,501 A * 11/2000 Magi ..... E05B 5/00 292/169
6,167,779 B1 * 1/2001 Sano ..... E05B 85/12 292/336.3
6,241,294 B1 6/2001 Young et al.
6,247,343 B1 6/2001 Weiss et al.
6,256,932 B1 7/2001 Jyawook et al.
6,361,091 B1 3/2002 Weschler
6,441,512 B1 8/2002 Jakel et al.
6,460,905 B2 * 10/2002 Suss ..... E05B 85/12 292/336.3
6,470,719 B1 10/2002 Franz et al.
6,523,376 B2 2/2003 Baukholt et al.
6,550,826 B2 4/2003 Fukushima et al.
6,554,328 B2 4/2003 Cetnar et al.
6,629,711 B1 10/2003 Gleason et al.
6,639,161 B2 10/2003 Meagher et al.
6,657,537 B1 12/2003 Hauler
6,701,671 B1 3/2004 Fukumoto et al.
6,712,409 B2 3/2004 Monig
6,768,413 B1 7/2004 Kemmann
6,883,839 B2 4/2005 Belmond et al.
6,976,717 B2 * 12/2005 Barr ..... E05B 79/06 292/336.3
6,988,752 B2 * 1/2006 Belchine, III ..... E05B 85/12 16/266
7,070,018 B2 7/2006 Kachouh
7,070,213 B2 7/2006 Willats et al.
7,091,823 B2 8/2006 Ieda
7,091,836 B2 8/2006 Kachouch et al.
7,097,226 B2 8/2006 Bingle et al.
7,126,453 B2 10/2006 Sandau et al.
7,173,346 B2 2/2007 Aiyama et al.
7,192,076 B2 3/2007 Ottino
7,221,255 B2 5/2007 Johnson et al.
7,222,459 B2 5/2007 Taniyama
7,325,843 B2 2/2008 Coleman et al.
7,375,299 B1 5/2008 Pudney
7,399,010 B2 7/2008 Hunt et al.
7,780,207 B2 8/2010 Gotou et al.
7,931,314 B2 4/2011 Nitawaki
7,937,893 B2 5/2011 Pribisic
8,141,916 B2 3/2012 Tomaszewski et al.
8,376,416 B2 2/2013 Arabia, Jr. et al.
8,451,087 B2 5/2013 Kirshnan et al.
8,474,889 B2 7/2013 Reifenberg et al.
8,544,901 B2 10/2013 Krishnan et al.
8,573,657 B2 11/2013 Papanikolaou et al.
8,727,401 B2 * 5/2014 Tanaka ..... E05B 85/12 292/336.3
8,746,755 B2 6/2014 Papanikolaou et al.
8,746,759 B2 * 6/2014 Bailey ..... E05B 85/12 292/336.3
8,864,193 B2 * 10/2014 Mori ..... E05B 79/20 292/336.3
8,915,524 B2 12/2014 Charnesky et al.
9,022,438 B2 * 5/2015 Mori ..... E05B 79/20 292/336.3
9,181,734 B2 * 11/2015 Minemura ..... E05B 85/12
10,196,838 B2 * 2/2019 Nagaoka ..... E05B 79/20
2001/0005078 A1 6/2001 Fukushima et al.
2003/0009855 A1 1/2003 Budzynski
2003/0101781 A1 6/2003 Budzynski et al.
2003/0107473 A1 6/2003 Pang et al.
2004/0021325 A1 * 2/2004 Schlack ..... E05C 1/065 292/110
2004/0155472 A1 * 8/2004 Barr ..... E05B 79/06 292/336.3
2004/0195845 A1 10/2004 Chevalier
2004/0212215 A1 * 10/2004 Minemura ..... B29C 45/2708 296/146.7
2004/0217601 A1 11/2004 Garnault et al.
2005/0067844 A1 * 3/2005 Pudney ..... E05B 85/12 292/336.3
2005/0121924 A1 * 6/2005 Chanya ..... E05B 85/107 292/336.3
2005/0134058 A1 * 6/2005 Belchine, III ..... E05B 85/12 292/336.3
2005/0134059 A1 * 6/2005 Ichino ..... E05B 85/12 292/336.3
2005/0146147 A1 * 7/2005 Niskanen ..... E05B 47/0009 292/336.3
2007/0001467 A1 1/2007 Muller et al.
2007/0115191 A1 5/2007 Hashiguchi et al.
2007/0126243 A1 6/2007 Papanikolaou et al.
2007/0170727 A1 7/2007 Kohlstand et al.
2008/0018120 A1 * 1/2008 Bailey ..... E05B 85/12 292/336.3
2008/0068129 A1 3/2008 Ieda et al.
2008/0157543 A1 * 7/2008 Homner ..... E05B 15/0295 292/95
2008/0203737 A1 8/2008 Tomaszewski et al.
2008/0217956 A1 9/2008 Gschweng et al.
2008/0224482 A1 9/2008 Cumbo et al.

(56) References Cited

U.S. PATENT DOCUMENTS

| | | | | |
|---|---|---|---|---|
| 2008/0250718 | A1 | 10/2008 | Papanikolaou et al. | |
| 2009/0033104 | A1 | 2/2009 | Konchan et al. | |
| 2009/0160211 | A1 | 6/2009 | Krishnan et al. | |
| 2010/0052337 | A1 | 3/2010 | Arabia, Jr. et al. | |
| 2010/0175945 | A1 | 7/2010 | Helms | |
| 2011/0154740 | A1 | 6/2011 | Matsumoto et al. | |
| 2011/0227351 | A1 | 9/2011 | Grosdemouge | |
| 2011/0266816 | A1* | 11/2011 | Kindig | E05B 85/103 292/336.3 |
| 2012/0032457 | A1* | 2/2012 | Ishikawa | E05B 17/106 292/336.3 |
| 2012/0068482 | A1* | 3/2012 | Takada | E05C 1/145 292/336.3 |
| 2012/0205925 | A1 | 8/2012 | Muller et al. | |
| 2013/0038074 | A1* | 2/2013 | Mori | E05B 79/20 292/336.3 |
| 2013/0076048 | A1* | 3/2013 | Aerts | E05B 85/103 292/336.3 |
| 2013/0079984 | A1 | 3/2013 | Aerts et al. | |
| 2013/0088022 | A1* | 4/2013 | Collado | E05B 85/12 292/336.3 |
| 2013/0104459 | A1 | 5/2013 | Patel et al. | |
| 2013/0221690 | A1* | 8/2013 | Rocci | E05B 77/06 292/336.3 |
| 2013/0229021 | A1* | 9/2013 | Wang | E05B 55/005 292/336.3 |
| 2014/0007404 | A1 | 1/2014 | Krishnan et al. | |
| 2014/0076094 | A1* | 3/2014 | Mori | E05B 79/20 74/502.2 |
| 2014/0352223 | A1* | 12/2014 | Le | E05B 17/002 49/344 |
| 2014/0373580 | A1* | 12/2014 | Le | E05B 41/00 70/224 |
| 2015/0069767 | A1* | 3/2015 | Nam | E05B 77/06 292/336.3 |
| 2015/0123411 | A1* | 5/2015 | Woo | E05B 1/0007 292/336.3 |
| 2015/0159399 | A1* | 6/2015 | Shah | E05B 7/00 292/336.3 |
| 2015/0184431 | A1* | 7/2015 | Da Deppo | E05B 85/10 292/336.3 |
| 2015/0191944 | A1 | 7/2015 | Kouzuma et al. | |
| 2015/0211253 | A1* | 7/2015 | Shah | E05B 7/00 292/336.3 |
| 2015/0218853 | A1* | 8/2015 | Higgins | E05B 83/26 292/336.3 |
| 2015/0225979 | A1* | 8/2015 | Garofoli | E05B 63/042 292/336.3 |
| 2015/0315811 | A1* | 11/2015 | Mao | E05B 5/003 292/336.3 |
| 2015/0345188 | A1* | 12/2015 | Puscas | E05B 85/14 292/336.3 |
| 2016/0135313 | A1* | 5/2016 | Freeman | H01H 3/02 |
| 2019/0017300 | A1* | 1/2019 | Amagai | E05B 79/02 |

FOREIGN PATENT DOCUMENTS

| | | |
|---|---|---|
| CN | 103264667 | 8/2013 |
| DE | 19642698 | 11/2000 |
| DE | 20121915 | 11/2003 |
| DE | 20 2008 003 845 | 9/2009 |
| DE | 102011051165 | 12/2012 |
| DE | 102015101164 | 7/2015 |
| DE | 102014107809 | 12/2015 |
| EP | 1284334 | 2/2003 |
| EP | 1338731 | 2/2005 |
| EP | 2053744 | 4/2009 |
| EP | 2 664 734 A2 | 11/2013 |
| JP | 62255256 | 11/1987 |
| JP | 05059855 | 3/1993 |
| KR | 20120108580 | 10/2012 |
| WO | 2013189695 | 12/2013 |

* cited by examiner

INSIDE OVERRIDE EMERGENCY HANDLE FOR DOOR RELEASE

FIELD OF THE INVENTION

The present disclosure generally relates to a motor vehicle emergency handle door release, and more particularly, to a simple, robust, lightweight integrated handle for an emergency door handle release for use in conjunction with electrically actuated door release systems.

BACKGROUND OF THE INVENTION

Some motor vehicles manufacturers offer mechanical emergency handle door releases, often in combination with electrically actuated door latch release systems, or so-called e-latch systems, which require a mechanical backup door release system for use by the vehicle occupants to allow the doors to be opened when there is no electrical power, especially in an emergency. Such mechanical emergency handle door releases, however, have generally been large, heavy, and expensive. Further, the use of a traditional style door latch handle often obviates the styling and design benefits of such e-latch systems and is not warranted given its minimal normal usage.

Further, some mechanical emergency handle door release systems employ an emergency handle located in interior locations which, given their infrequency of use, may not be readily observable or known to the vehicle occupants. This shortcoming is compounded by the fact that the use of such mechanical emergency handle door release systems may be necessary in an emergency situation, when intuitive actuation of the mechanical emergency handle door release by the vehicle occupant is necessary.

An improvement over such electronically actuated door release systems having a motor vehicle emergency handle door release was desired.

SUMMARY OF THE INVENTION

According to one aspect of the present disclosure, a simple, robust, low-cost, and light-weight integrated emergency handle door release is disclosed, having a handle with a door latch release cable end fitting and being attached through the door trim near the map pocket where an emergency release is thought to be expected. The disclosed emergency handle door release is thus easy to find and operate, requires minimal componentry and comprises a housing having a pair of opposed walls extending from a first end to a second end of the housing, wherein each of the opposed walls has an interior surface, and one of a pair of opposed pivot bosses disposed on the interior surface of each of the opposed walls. A pivotable handle has a stowed and an actuated position, and comprises a pivot mount, a lever disposed on one side of the pivot mount, and a door latch release cable end fitting disposed on another side of the pivot mount. The pivot mount includes a pair of opposed pivots extending laterally from the pivot mount of the pivotable handle and one of the pair of opposed pivots extends laterally through and is received within one of the pivot bosses disposed on the interior surface of each of the opposed walls when the emergency handle door release is assembled. A spring has a first leg disposed against a surface of the housing and a second leg disposed against a surface of the pivotable handle urging the pivotable handle to the stowed position.

According to another aspect of the present disclosure, a door release comprises a housing having a pivot boss disposed on each of a pair of opposed walls, a handle having a lever disposed on one side of a pivot mount, a cable end fitting disposed on another side of the pivot mount, and a pair of opposed pivots disposed within the pivot bosses, and a spring disposed against each of the housing and handle urging the handle to a stowed position.

According to yet another aspect of the present disclosure, a motor vehicle emergency handle door release comprises a housing forming a substantially rectangular structure having a first end and a second end, a pair of opposed walls extending from the first to the second end wherein each of the opposed walls has an interior surface, and one of a pair of opposed pivot slots disposed on the interior surface of each of the opposed walls, each of the opposed pivot slots terminating in a pivot boss, and wherein each of the opposed pivot slots comprise an open-ended channel having opposed inclined surfaces narrowing to a throat portion proximate an open end of the open-ended channel and terminating at one of the pivot bosses at a terminal end of the open-ended channel. A pivotable handle has a stowed and an actuated position, and comprises a pivot mount, a lever disposed on one side of the pivot mount, and a door latch release cable end fitting disposed on another side of the pivot mount, wherein the pivot mount includes a pair of opposed pivots extending laterally from the pivot mount of the pivotable handle and one of the pair of opposed pivots extends laterally through and is received within one of the pivot bosses disposed on the interior surface of each of the opposed walls when the emergency handle door release is assembled. The pivotable handle further comprises a pair of cross-members mounted to an internal surface of the pivotable handle opposite the pair of opposed pivots in the pivot mount of the pivotable handle. A torsion spring has a first leg disposed against a surface of the housing, a second leg disposed against a surface of the pivotable handle urging the pivotable handle to the stowed position, and a pair of coiled center portions coupled with the cross-members.

These and other aspects, objects, and features of the present disclosure will be understood and appreciated by those skilled in the art upon studying the following specification, claims, and appended drawings.

DETAILED DESCRIPTION OF THE EMBODIMENTS

Figure 1:
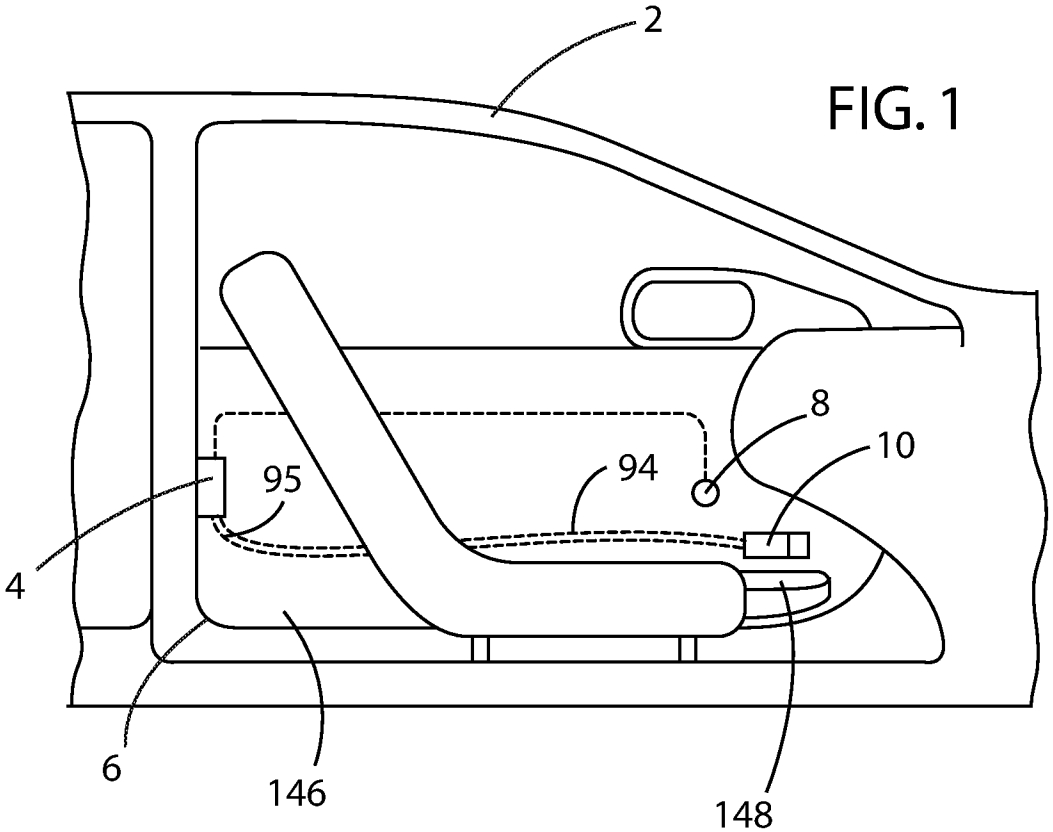
FIG. 1 is a schematic side view of a motor vehicle door assembly equipped with the emergency handle door release according to the present disclosure.

As referenced in the figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in FIG. 1. However, it is to be understood that the present disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figure 2:
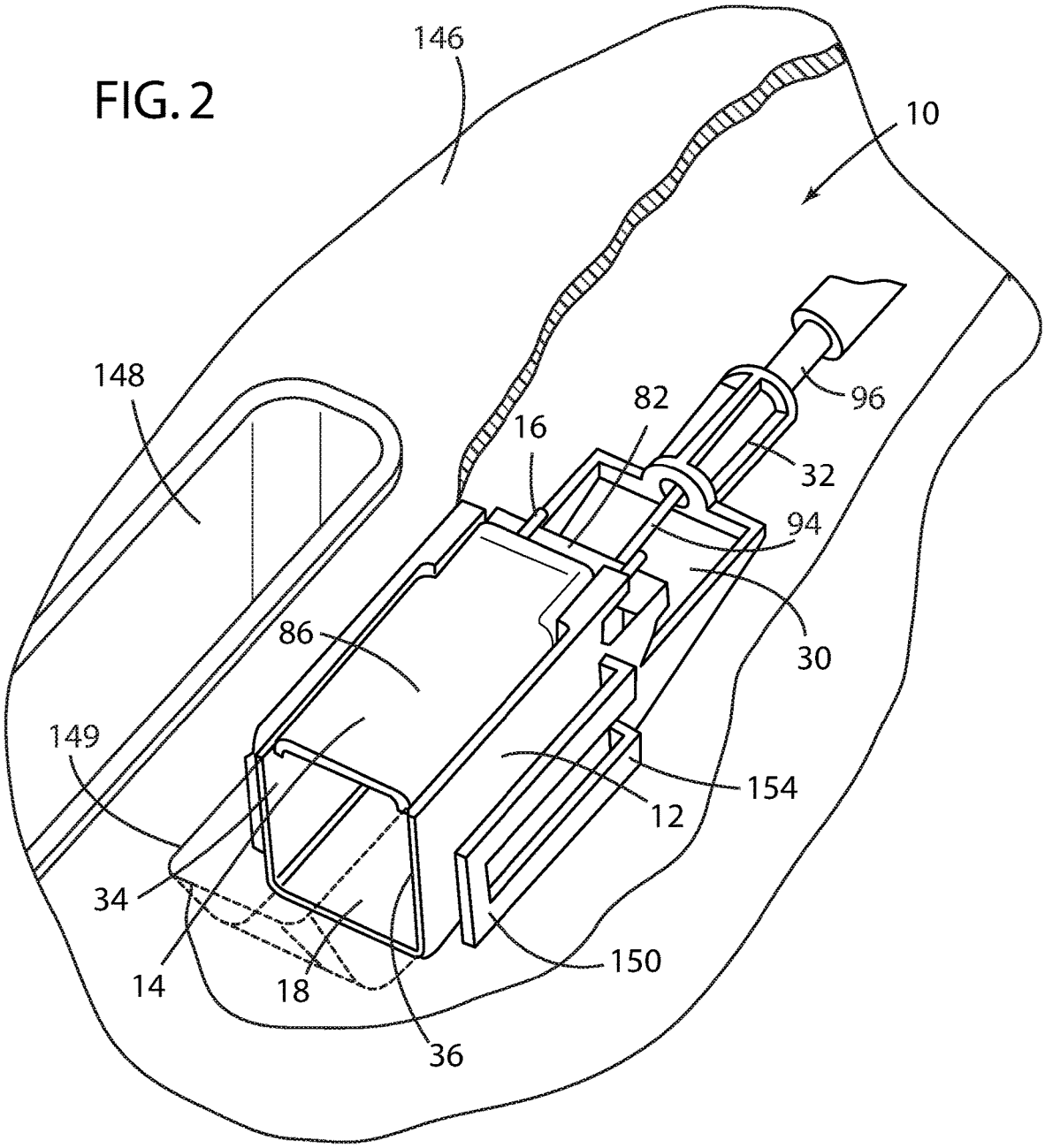
FIG. 2 is a front side perspective view of a motor vehicle emergency handle door release according to the present disclosure.

Referring to FIGS. 1 and 2, reference numeral 2 generally designates the body structure of a motor vehicle 1. The body structure 2 includes a mechanical door latch assembly 4, which releasably allows a door 6 to be opened and latched closed relative to the body structure 2. In a preferred embodiment of the present disclosure, the mechanical door latch assembly 4 is capable of being electronically actuated via an e-latch button 8. In the event that the e-latch button 8 is inoperable for any reason, such as a loss of vehicle power, the motor vehicle emergency handle door release 10 of the present disclosure is provided.

The motor vehicle emergency handle door release 10 primarily comprises a housing 12, a pivotable handle 14, and a spring 16. The housing 12 is preferably formed from a structurally robust and durable plastic resin material, more preferably such as POM acetal, 30% GF polypro or nylon (PA6) via an injection molding process, into a substantially rectangular structure having a base 18 and a pair of opposed walls 20, 22 extending between a first end 24 and a second end 26 of the housing 12. Preferably, each of the first and second ends 24, 26 of the housing 12 is open, and the side of the substantially rectangular structure opposite the base 18 is likewise open and forms an open traverse 28 between the opposed walls 20, 22 within which the pivotable handle 14 is received, as further discussed below. The base 18 also includes an inclined cable brace mount 30 extending from the second end 26 to which a cable brace 32 is attached.

Each of the opposed walls 20, 22 has an interior surface 34, 36, where one of a pair of opposed pivot slots 38, 40 is disposed on the interior surface 34, 36 of each of the opposed walls, respectively, preferably proximate an upper portion 42, 44 thereof near the second end 26 of the housing 12. In turn, each of the opposed pivot slots 38, 40 terminates in a pivot boss 46, 48. Preferably, each of the opposed pivot slots 38, 40 comprises an open-ended channel 50, 52 having opposed inclined surfaces 54 narrowing to a throat portion 56 proximate an open end 58 of the open-ended channel 50, 52 and terminating at one of the pivot bosses 46, 48 at a terminal end of the open-ended channel 50, 52. The pivot bosses 46, 48 preferably are defined by a first portion 64 formed by a curved surface 66 at the terminal end 60 of the open-ended channel 50, 52 and a second portion 68 formed by an opposed curved surface 70 proximate an edge 72 of each of the opposed walls 20, 22. Preferably, the spacing between the interior surfaces 34, 36 of the opposed walls 20, 22 is slightly less that the spacing between the outer surfaces 74, 76 of a pair of opposed pivots 78, 80 on the pivotable handle 14.

Figures 3, 4:
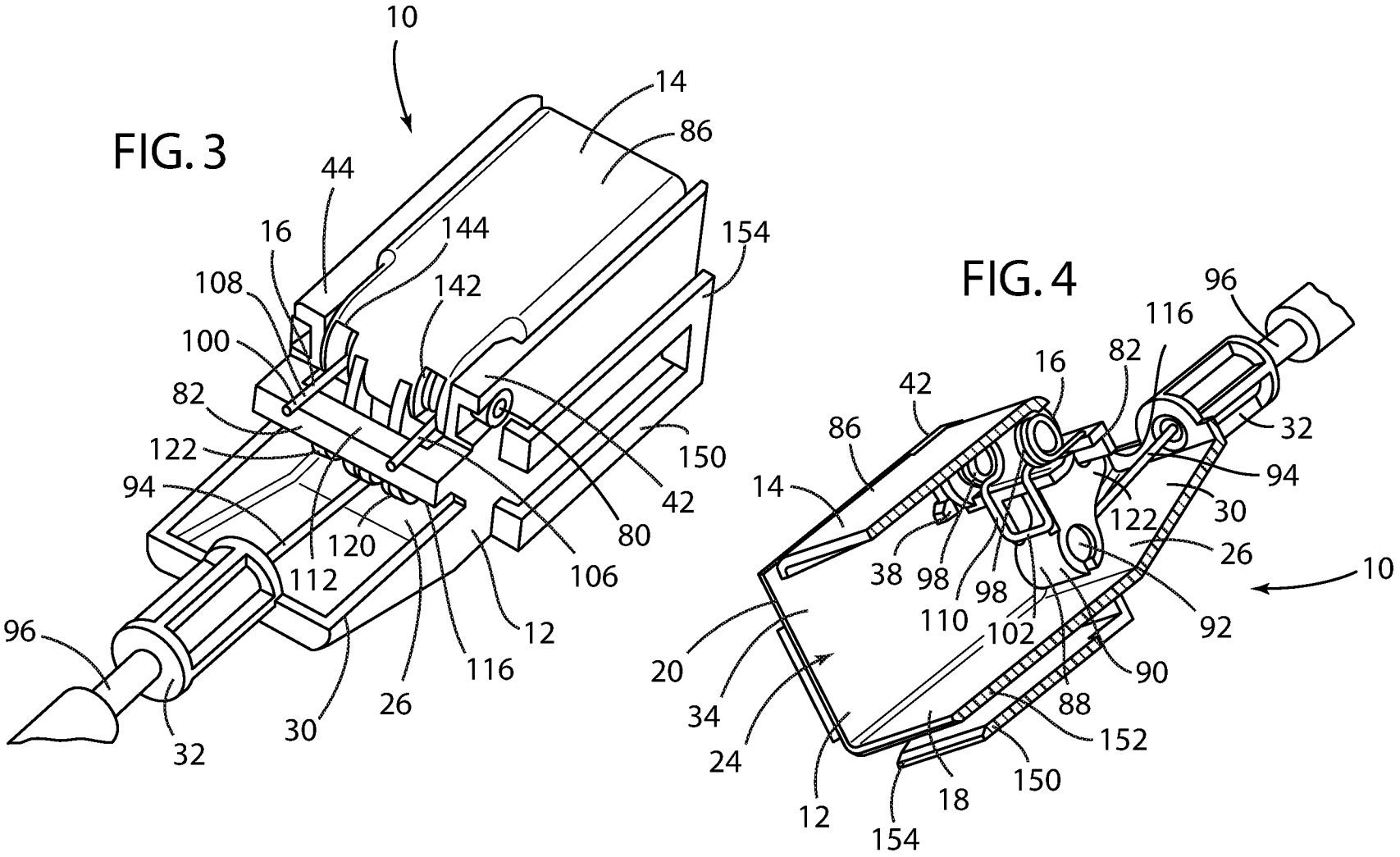
FIG. 3 is a rear side perspective view of the motor vehicle emergency handle door release of FIG. 2 according to the present disclosure.
FIG. 4 is a front side cross-sectional perspective view of the motor vehicle emergency handle door release of FIG. 2 according to the present disclosure.
Figure 5:
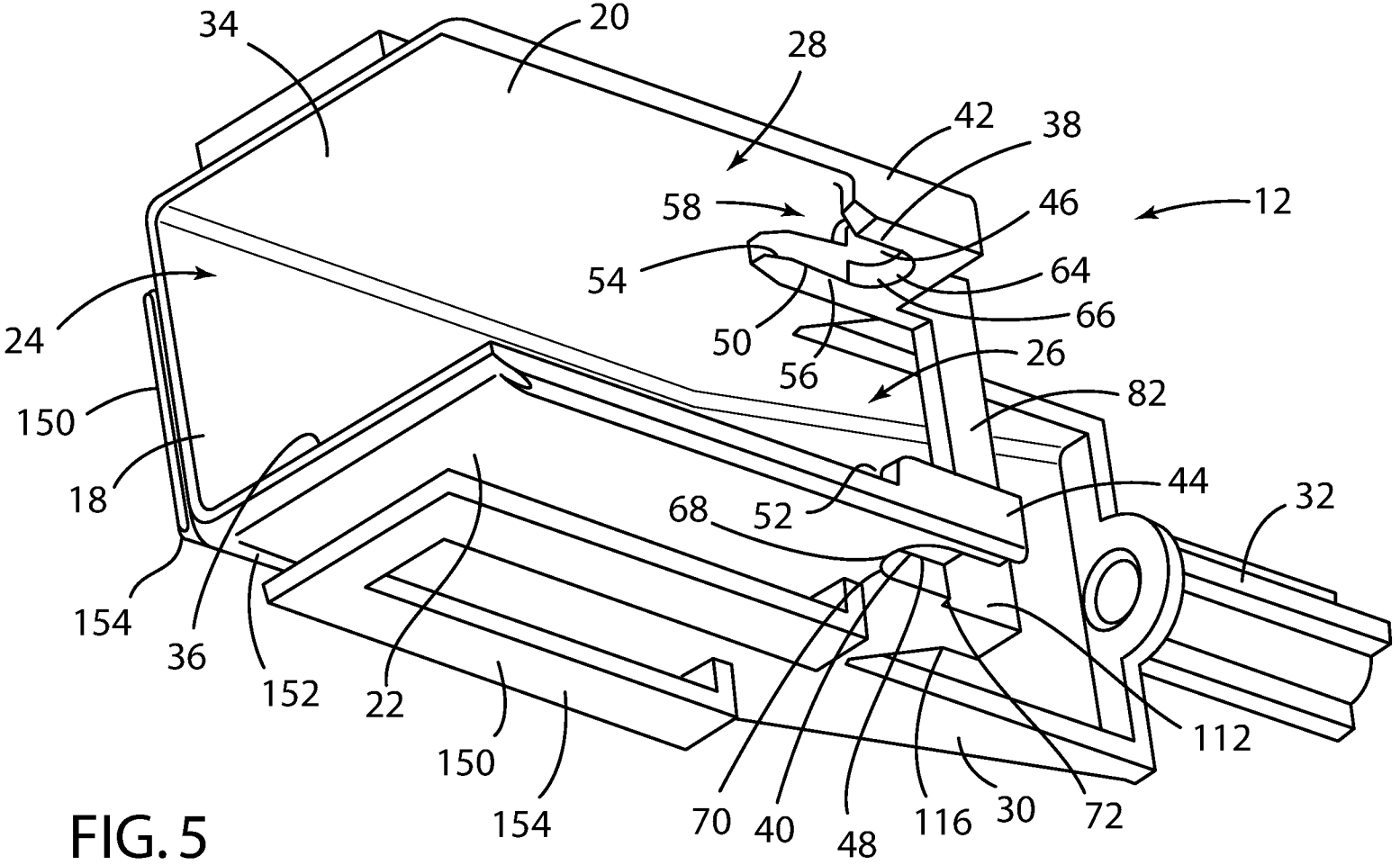
FIG. 5 is a front side perspective view of a first embodiment of the housing of the motor vehicle emergency handle door release of FIG. 2 according to the present disclosure.
Figure 6:
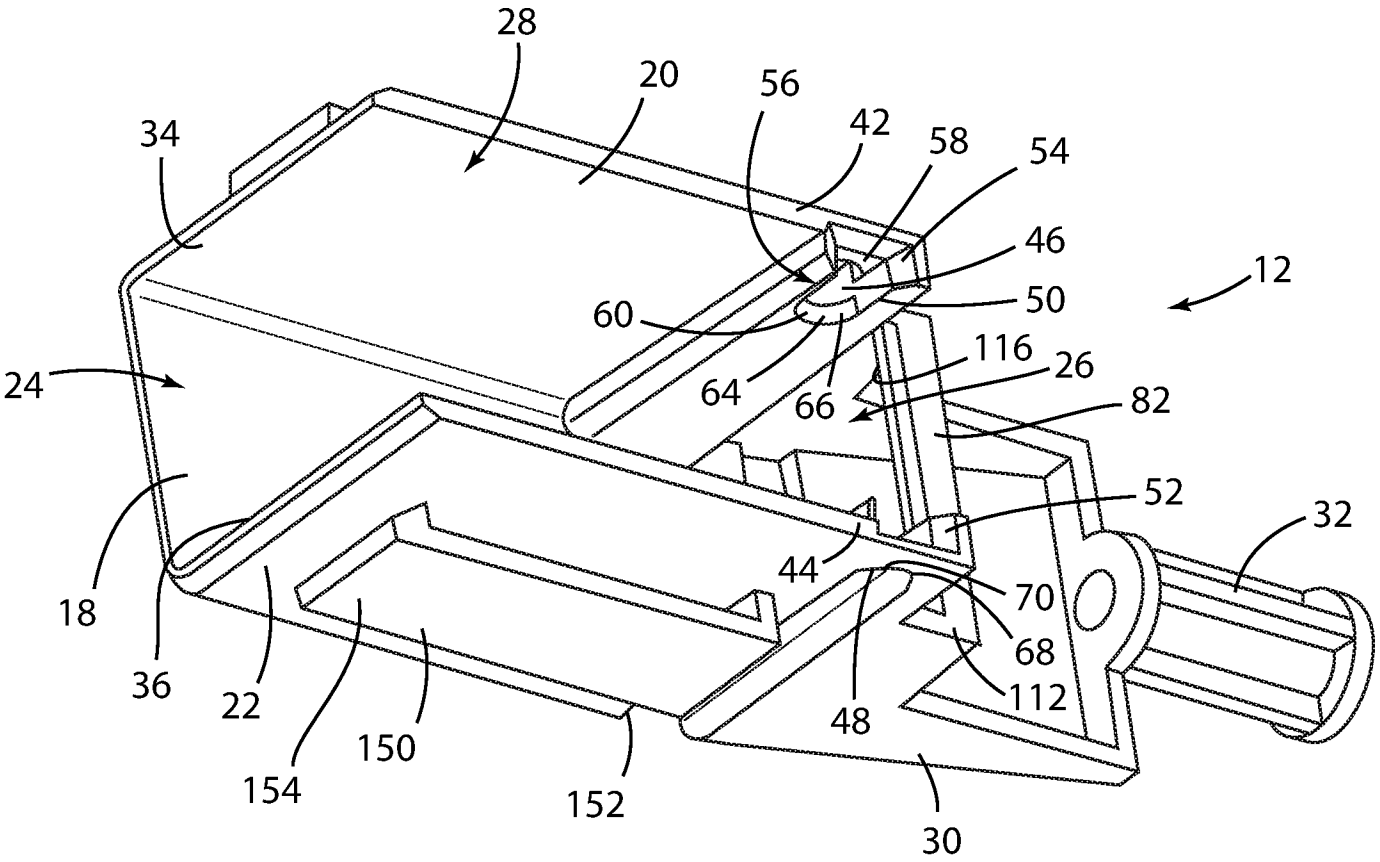
FIG. 6 is a front side perspective view of a second embodiment of the housing of the motor vehicle emergency handle door release according to the present disclosure.
Figure 8:
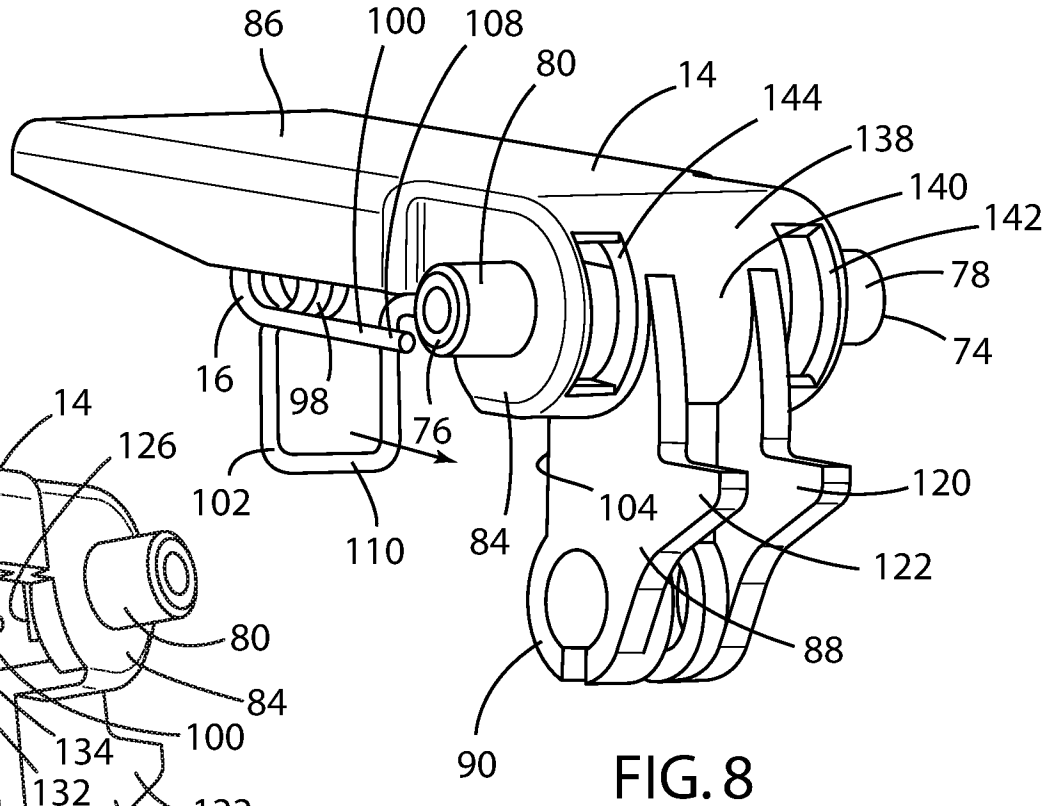
FIG. 8 is a rear side perspective view of the pivotable handle and spring of the motor vehicle emergency handle door release of FIG. 2 according to the present disclosure.

Preferably, the housing 12 also has a shelf 82 disposed at the second end 26 of the housing 12 that is attached to each of the opposed walls 20, 22 at the open second end 26 of the housing 12 and that spans the open second end 26, as shown in FIGS. 3, 5, and 6. The shelf 82 is thus preferably displaced by a short distance from the pivot bosses 46, 48, as shown in FIGS. 5 and 6, so as to allow the opposed walls 20, 22 to flex slightly outward as the pair of opposed pivots 78, 80 of the pivotable handle 14 is inserted into and slid through the open-ended channels 50, 52 of the opposed pivot slots 38, 40 and snapped into engagement with the pivot bosses 46, 48, as further discussed below. With the pair of opposed pivots 78, 80 engaged by the pair of pivot bosses 46, 48, the opposed walls 20, 22 return to their normal position to restrain the pair of opposed pivots 78, 80 within the pair of pivot bosses 46, 48.

Figure 9:
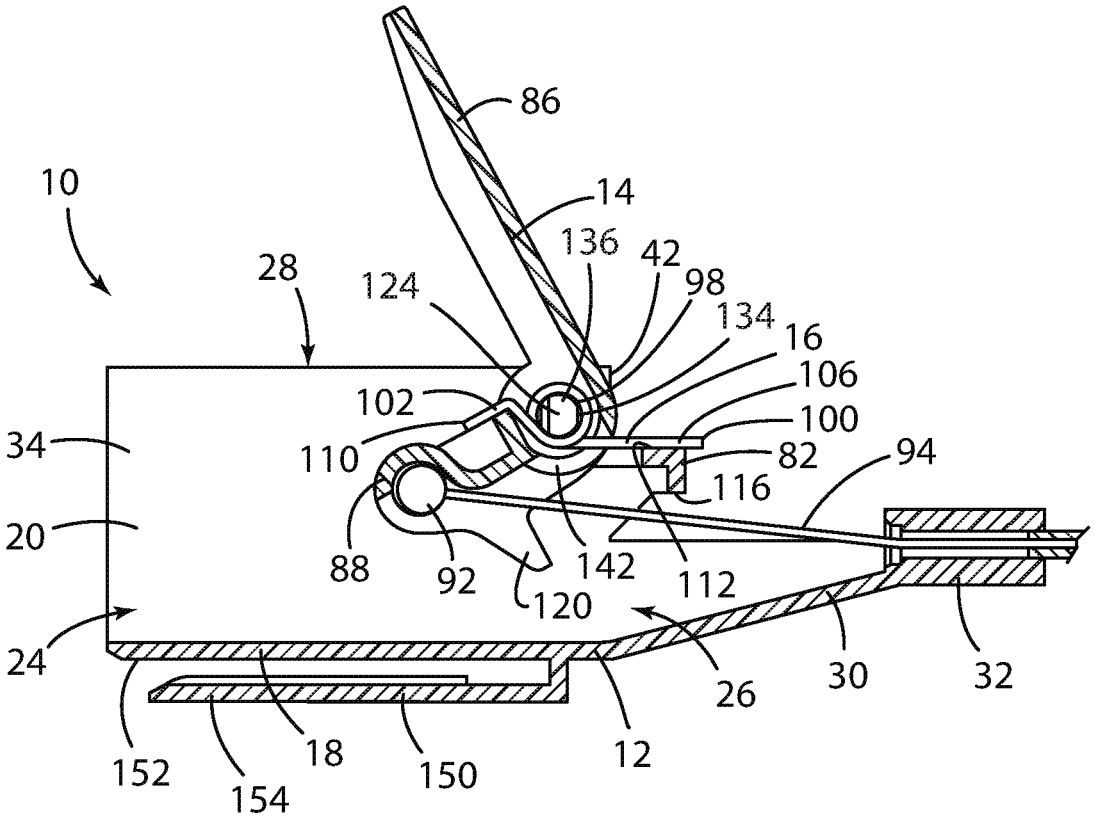
FIG. 9 is a side cross-sectional view of the motor vehicle emergency handle door release of FIG. 2 according to the present disclosure with the pivotable handle in the actuated position.
Figure 10:
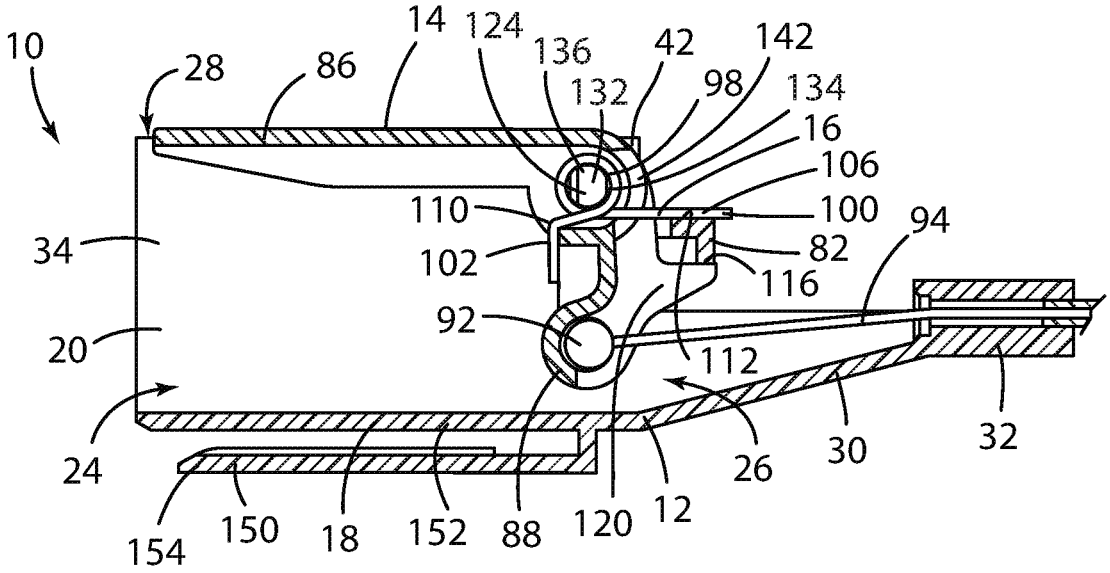
FIG. 10 is a side cross-sectional view of the motor vehicle emergency handle door release of FIG. 2 according to the present disclosure with the pivotable handle in the stowed position.
Figure 11:
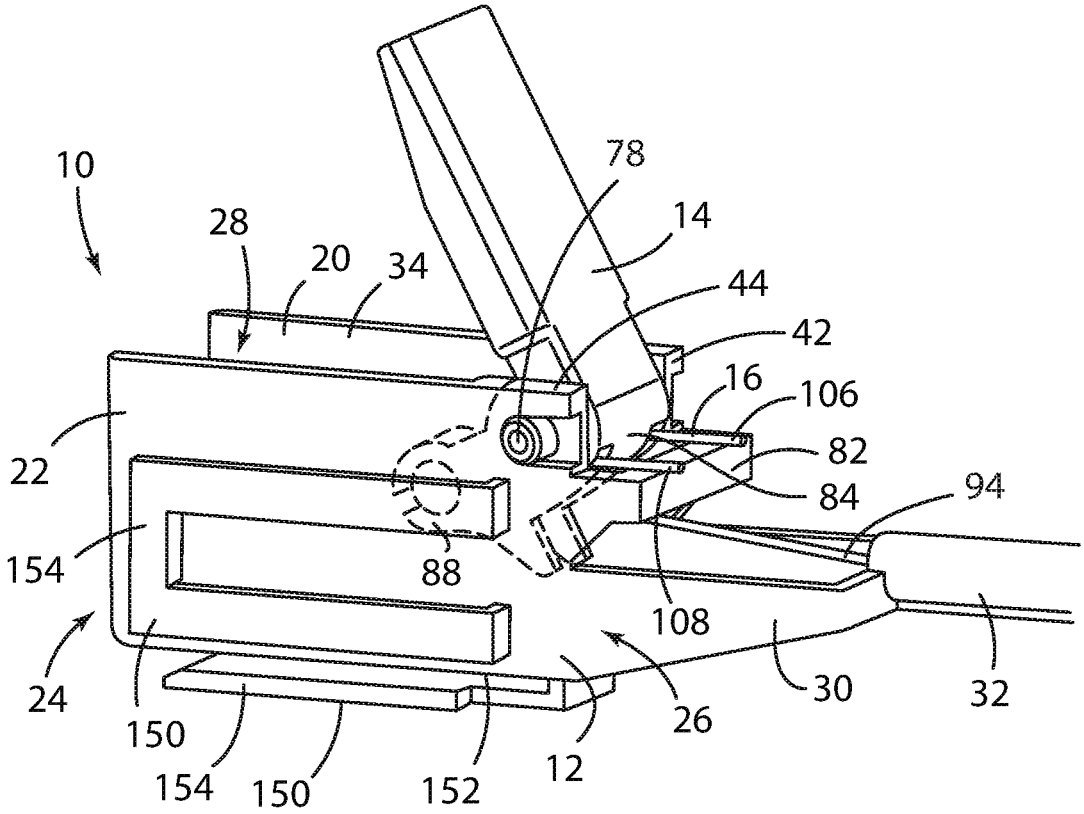
FIG. 11 is a rear side perspective view of the motor vehicle emergency handle door release of FIG. 2 according to the present disclosure with the pivotable handle in the actuated position.
Figure 12:
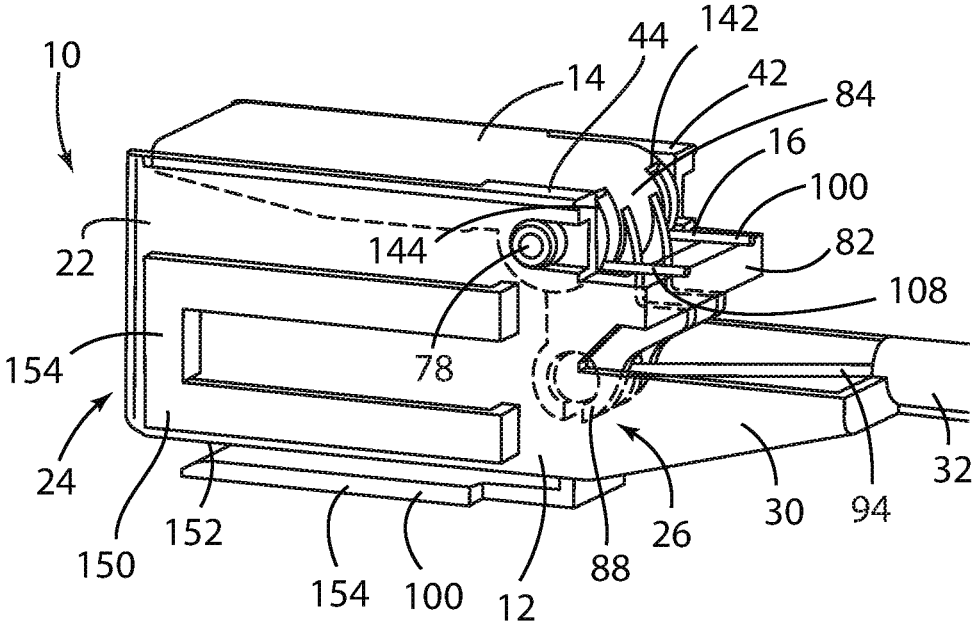
FIG. 12 is a rear side perspective view of the motor vehicle emergency handle door release of FIG. 2 according to the present disclosure with the pivotable handle in the stowed position.

The pivotable handle 14 is also preferably formed from POM acetal, 30% GF polypro and nylon (PA6) via an injection molding process and comprises a pivot mount 84, a lever 86 disposed on one side of the pivot mount 84, toward the first end 24, and a door latch release cable end fitting 88 disposed on another side of the pivot mount 84. Preferably, the lever 86 disposed on the pivot mount 84 extends at an oblique angle relative the door latch release cable end fitting 88 disposed on the pivot mount 84. More preferably, the lever 86 disposed on the pivot mount 84 extends at an angle of proximately 90° relative the door latch release cable end fitting 88 disposed on the pivot mount 84, as best shown in FIGS. 9 and 10.

The door latch release cable end fitting 88 preferably comprises a cylindrical clasp 90 into which a first end 92 of a Bowden cable 94 may be secured. The Bowden cable 94 is further directed through the cable brace mount 30 to restrain the sleeve 96 of the Bowden cable 94 against the cable brace 32 to actuate the Bowden cable 94, as is known to those having ordinary skill in the art. Preferably, the Bowden cable 94 proximate the first end 92 is incorporated in the cable brace mount 30 through a heat staking or over-molding process so that it is essentially encased within the cable brace mount 30, as shown in FIGS. 2, 3, 4, 9, and 10. An opposite end 95 of the Bowden cable 94 is attached to a mechanical door latch assembly 4 and is configured to actuate the mechanical door latch assembly 4 when the lever 86 disposed on the pivotable handle 14 is actuated and the pivotable handle 14 is displaced from a stowed position to an actuated position, even without electrical power being supplied to the motor vehicle. In so doing, the Bowden cable 94 actuates the mechanical door latch assembly 4 to open the door 6.

The pivot mount 84 includes the pair of opposed pivots 78, 80 extending laterally from the pivot mount 84 of the pivotable handle 14. When installed in the housing 12, one of the pair of opposed pivots 78, 80 extends laterally through and is received within one of the pivot bosses 46, 48 disposed on the interior surface 34, 36 of each of the opposed walls 20, 22, as described above. To facilitate such an installation, the opposed pivot slots 38, 40 are disposed adjacent the open traverse 28 to readily receive the pair of opposed pivots 78, 80. As shown in FIG. 5, in a first embodiment, the opposed pivot slots 38, 40 extend longitudinally within the housing 12, so that the pair of opposed pivots 78, 80 may be brought into engagement with the pivot bosses 46, 48 by longitudinal displacement of the pivotable handle 14 within the housing 12. Alternatively, as shown in FIG. 6, in a second embodiment, the opposed pivot slots 38, 40 may extend obliquely within the housing 12, so that the pair of opposed pivots 78, 80 may be brought into engagement with the pivot bosses 46, 48 by oblique displacement of the pivotable handle 14 within the housing 12. In the case where the first end 92 of the Bowden cable 94 is overmolded with the housing 12, the second embodiment may be more advantageous in view of tooling and drafting requirements. In either embodiment, the throat portion 56 of the open-ended channels 50, 52 of the opposed pivot slots 38, 40 are spaced apart by a distance slightly greater than an outer diameter of the opposed pivots 78, 80 in order to facilitate accurate and easy assembly.

The spring 16 preferably comprises a torsion steel wire spring having a pair of coiled center portions 98 disposed within the housing 12 and a first leg 100 disposed against a surface of the housing 12 and a second leg 102 disposed against a oblique surface 104 of the pivotable handle 14 urging the pivotable handle 14 to the stowed position. Preferably, the first leg 100 of the spring 16 is a pair of distal ends 106, 108 of the spring 16, and the second leg 102 of the spring 16 is a bent loop 110. As shown in FIGS. 3, 4, 9, 10, 11, and 12, the pair of distal ends 106, 108 of the spring 16 that form the first leg 100 of the spring 16 extend over and are urged against the shelf 82 attached to each of the opposed walls 20, 22 at the open second end 26 of the housing 12 and spanning the open second end 26. An upper surface 112 of the shelf 82 disposed at the open second end 26 of the housing 12 thus forms the surface of the housing 12 against which the first leg 100 comprising the pair of distal ends 106, 108 of the spring 16 is disposed. The bent loop 110 that forms the second leg 102 of the spring 16 is disposed at an oblique angle (preferably 90°) to the pair of distal ends 106, 108 of the spring 16 and is situated so as to obliquely lay against the oblique surface 104 of the pivotable handle 14 proximate the pivot mount 84.

Preferably, a lower surface 116 of the shelf 82 forms a surface 118 on the housing 12 against which a pair of lever stops 120, 122 disposed on the pivotable handle 14 is disposed when the pivotable handle 14 is urged to the stowed position. As shown in FIGS. 7, 8, 9, 10, 11 and 12, the pair of lever stops 120, 122 disposed on the pivotable handle 14 extends in the opposite direction from the lever 86 when the pivotable handle 14 is in its stowed position. With the spring 16 situated relative the upper surface 112 of the shelf 82 on the housing 12 and the oblique surface 104 on the pivotable handle 14, the pivotable handle 14 is thus urged to its normal stowed position and against the pair of lever stops 120, 122, unless the lever 86 is acted upon by a vehicle occupant to place the pivotable handle 14 to its actuated position.

The pivotable handle 14 further comprises a pair of spring cross-members 124, 126 mounted to opposed internal surfaces 128, 130 of the pivotable handle 14 opposite the pair of opposed pivots 78, 80 in the pivot mount 84 of the pivotable handle 14. The spring cross-members are adapted to engage the coiled center portions 98 of the torsion spring 16 and to restrain and mount the spring 16 within the pivotable handle 14. Preferably, the spring cross-members 124, 126 form a cylindric section 136 having an inclined surface 132 and a stop 134. During assembly, the inclined surfaces 132 of the spring cross-members 124, 126 urge the coiled center portions 98 of the torsion spring 16 together as the coiled center portions 98 are pushed over the inclined surface 132 of the cylindric section 136 of the spring cross-members 124, 126 and brought into engagement with the stop 134 of the spring cross-members 124, 126 to snap in place.

Figure 7:
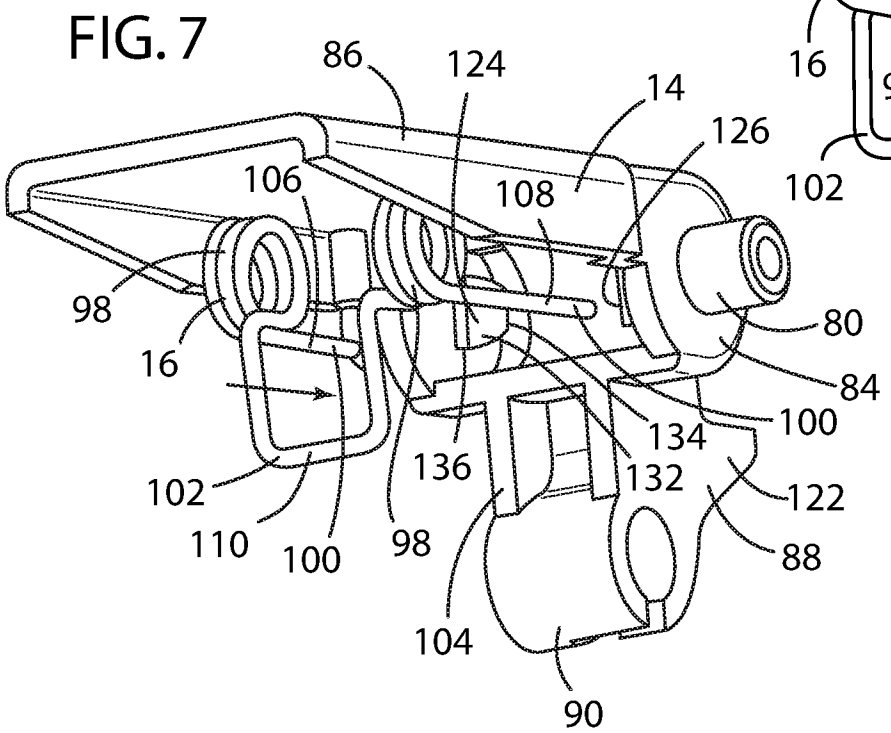
FIG. 7 is a front side perspective view of the pivotable handle and spring of the motor vehicle emergency handle door release of FIG. 2 according to the present disclosure.

Preferably, the pivot mount 84 forms a partial cylinder 138 having a curved wall 140, as shown in FIG. 7, and a pair of slots 142, 144 is provided through the curved wall 140 of the partial cylinder 138 through which the first leg 100 comprising the pair of distal ends 106, 108 of the spring 16 is inserted and thereby brought into engagement with the upper surface 112 of the shelf 82 disposed at the open second end 26 of the housing 12.

The emergency handle door release 10 is preferably mounted to the door trim panel 146 proximate a map pocket 148 so as to expose the lever 86, so that the lever 86 can be readily actuated by the vehicle occupant by simply inserting a finger in a recess 149 in the door trim panel adjacent the emergency handle door release 10 and lifting the lever 86 and rotating the pivotable handle 14. Preferably, an attachment interface 150 is disposed on one or more of the surfaces of the exterior wall 152 of the housing 12 defined by the exterior surface of each of the base 18 and the opposed walls 20, 22. The attachment interface 150 can be one or more resilient clips 154 that secure the housing 12 to an interior door structure member (not shown), whereby the housing 12 can be slid into position until the resilient clip 154 engages a feature of the interior door structure member that otherwise secures the resilient clip 154 in the housing in position, as is known in the art. Alternatively, the housing 12 for the emergency handle door release 10 may be bolted into position by the use of one or more fasteners (not shown). The objective is that the housing 12 for the emergency handle door release 10 be securely mounted so that the load applied to the lever 86 to displace the pivotable handle 14 from the stowed to the actuated position is reliably and positively communicated through the Bowden cable 94 to the mechanical door latch assembly 4.

A particular advantage of the emergency handle door release 10 according to the present disclosure is that assembly can be readily accomplished. First, the first end 92 of the Bowden cable 94 is attached by heat staking or molding the first end 92 of the Bowden cable 94 to the cable brace mount 30 and cable brace 32 of the housing 12. The spring 16 is then slid into the pivotable handle 14 so that the pair of distal ends 106, 108 of the spring 16 extends through the slots 142, 144 in the pivot mount 84. The inclined surfaces 132 of the spring cross-members 124, 126 urge the coiled center portions 98 of the torsion spring 16 together as the coiled center portions 98 are pushed over the inclined surface 132 of the cylindric section 136 of the spring cross-members 124, 126 and brought into engagement with the stop 134 of the spring cross-members 124, 126. Once so engaged, the second leg 100 of the spring 16 is disposed against the oblique surface 104 of the pivotable handle 14.

With the spring 16 assembled with the pivotable handle 14, the pivotable handle 14 is inserted into the open traverse 28 between the opposed walls 20, 22 and the opposed pair of pivots 78, 80 is brought into alignment with the pair of opposed pivot slots 38, 40 formed on the interior surface 34, 36 of the opposed walls 20, 22. The pair of opposed pivots 78, 80 of the pivotable handle 14 is further pushed into the opposed pivot slots 38, 40 within the housing 12 until the pair of opposed pivots 78, 80 is brought into engagement with the pivot bosses 46, 48. Insertion is facilitated with the throat portion 56 of the open-ended channels 50, 52 of the opposed pivot slots 38, 40 being spaced apart by a distance slightly greater than an outer diameter of the opposed pivots 78, 80, which acts as a guide during assembly. As the pivotable handle 14 is inserted in the opposed pivot slots 38, 40, the opposed walls 20, 22 are caused to flex slightly outward as the pair of opposed pivots 78, 80 of the pivotable handle 14 is inserted into and slid through the open-ended channels 50, 52 of the opposed pivot slots 38, 40 and into engagement with the pivot bosses 46, 48, as discussed above.

During this assembly step, the pair of distal ends 106, 108 of the spring 16 inserted through the pair of slots 142, 144 provided in the curved wall 140 of the pivot mount 84 are brought into engagement with the upper surface 112 of the shelf 82 disposed at the open second end 26 of the housing 12. Once the pivotable handle 14 is installed in the housing 12, the first end 92 of the Bowden cable 94 can be attached to the cylindrical clasp 90 of the pivotable handle 14 and the emergency door handle release 10 can be installed in the door 6 as described above.

It will be understood by one having ordinary skill in the art that construction of the described present disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "operably connected" generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An emergency handle door release for a motor vehicle adapted for urgent use comprising:

a housing having a pair of opposed walls extending from a first end to a second end of the housing, wherein each of the opposed walls has an interior surface, and one of a pair of opposed pivot bosses disposed on the interior surface of each of the opposed walls;

a pivotable handle having a stowed and an actuated position, the pivotable handle comprising a pivot mount, a lever disposed on one side of the pivot mount, and a door latch release cable end fitting disposed on another side of the pivot mount, wherein the pivot mount includes a pair of opposed pivots extending laterally from the pivot mount of the pivotable handle and one of the pair of opposed pivots extends laterally through and is received within one of the pivot bosses disposed on the interior surface of each of the opposed walls; and a spring having a first leg disposed against a surface of the housing and a second leg disposed against a surface of the pivotable handle urging the pivotable handle to the stowed position;

wherein the lever disposed on the pivot mount extends at an oblique angle relative the door latch release cable end fitting disposed on the pivot mount and the spring comprises a torsion spring wire having a pair of coiled center portions, and wherein the first leg of spring is a pair of distal ends of the torsion spring wire and the second leg of the torsion spring wire is a bent loop.

2. The emergency handle door release of claim 1, wherein the housing has a pair of opposed pivot slots disposed on the interior surface of each of the opposed walls, each of the pivot slots terminating in one of the pair of pivot bosses, and an open traverse between the opposed walls within which the pivotable handle is received, the pivot slots being disposed adjacent the open traverse to receive the pair of opposed pivots.

3. The emergency handle door release of claim 2, wherein the pivot slots extend longitudinally within the housing and the pair of opposed pivots is brought into engagement with the pivot bosses by longitudinal displacement of the pivotable handle within the housing.

4. The emergency handle door release of claim 2, wherein the pivot slots extend obliquely within the housing and the pair of opposed pivots is brought into engagement with the pivot bosses by oblique displacement of the pivotable handle within the housing.

5. The emergency handle door release of claim 1, wherein the housing has a shelf disposed at the second end of the housing that forms the surface against which the first leg of the spring is disposed.

6. The emergency handle door release of claim 2, wherein a shelf is attached to each of the opposed walls at an open end of the housing and spans the open end, and wherein the shelf is displaced from the pivot bosses.

7. The emergency handle door release of claim 1, wherein the pair of coiled center portions of the torsion spring are disposed within the housing and the pivotable handle further comprises a pair of spring cross-members mounted to an internal surface of the pivotable handle opposite the pair of opposed pivots in the pivot mount of the pivotable handle that engage the coiled center portions of the torsion spring.

8. The emergency handle door release of claim 7, wherein the spring cross-members form a cylindric section having an inclined surface and a stop, and wherein the spring cross-members urge the coiled center portions of the torsion spring together as the coiled center portions are pushed over the inclined surface of the cylindric section of the spring cross-members and brought into engagement with the stop of the spring cross-members.

9. The emergency handle door release of claim 1, wherein the pair of distal ends of the torsion spring wire extend over and are urged against a shelf attached to each of the opposed walls at an open end of the housing and spanning the open end, and wherein the shelf is displaced from the pivot bosses.

10. The emergency handle door release of claim 9, further comprising an attachment interface disposed on an exterior wall of the housing.

11. A door release comprising:

a housing having a pivot boss disposed on each of a pair of opposed walls, wherein the housing comprises a substantially rectangular structure having a first end and a second end, the opposed walls extend from the first end to the second end, and each of the opposed walls has an interior surface and a pair of pivot slots disposed on the interior surface of each of the opposed walls, each of the pivot slots terminating in one of the pivot bosses;

a handle comprising a lever disposed on one side of a pivot mount, a cable end fitting disposed on another side of the pivot mount, and a pair of opposed pivots disposed within the pivot bosses; and a spring disposed against each of the housing and the handle urging the handle to a stowed position;

wherein each of the pivot slots comprise an open-ended channel having opposed inclined surfaces narrowing to a throat portion proximate an open end of the open-ended channel and terminating at one of the pivot bosses at a terminal end of the open ended channel, the throat portion having a spacing greater than an outer diameter of the opposed pivots.

12. The door release of claim 11, wherein the pivot bosses comprise a first portion formed by a curved surface at the terminal end of the open-ended channel and a second portion formed by an opposed curved surface proximate an edge of one of the opposed walls.

13. The door release of claim 11, wherein the spring comprises a first leg disposed against a surface of the housing and a second leg disposed against a surface of the handle urging the handle to the stowed position.

14. A motor vehicle emergency handle door release adapted for urgent use comprising:

a housing forming a substantially rectangular structure having a first end and a second end, a pair of opposed walls extending from the first to the second end wherein each of the opposed walls has an interior surface, and one of a pair of pivot slots disposed on the interior surface of each of the opposed walls, each of the pivot slots terminating in a pivot boss, and wherein each of the pivot slots comprise an open-ended channel having opposed inclined surfaces narrowing to a throat portion proximate an open end of the open-ended channel and terminating at one of the pivot bosses at a terminal end of the open-ended channel;

a pivotable handle having a stowed and an actuated position, the pivotable handle comprising a pivot mount, a lever disposed on one side of the pivot mount, and a door latch release cable end fitting disposed on another side of the pivot mount, wherein the pivot mount includes a pair of opposed pivots extending laterally from the pivot mount of the pivotable handle and one of the pair of opposed pivots extends laterally through and is received within one of the pivot bosses disposed on the interior surface of each of the opposed walls, and wherein the pivotable handle further comprises a pair of cross-members mounted to an internal surface of the pivotable handle opposite the pair of opposed pivots in the pivot mount of the pivotable handle; and a torsion spring having a first leg disposed against a surface of the housing, a second leg disposed against a surface of the pivotable handle urging the pivotable handle to the stowed position, and a pair of coiled center portions coupled with the cross-members.

15. The emergency handle door release of claim 14, wherein the pivot bosses comprise a first portion formed by a curved surface at the terminal end of the open-ended channel and a second portion formed by an opposed curved surface proximate an edge of one of the opposed walls.

16. The emergency handle door release of claim 14, wherein the cross-members form a cylindric section having an inclined surface and a stop, and wherein the cross-members urge the coiled center portions of the torsion spring together as the coiled center portions are pushed over the inclined surface of the cylindric cross-members and brought into engagement with the stop of the cross-members.

17. The emergency handle door release of claim 14, wherein the second end of the housing is an open end and the housing has a shelf disposed at the second end of the housing attached to each of the opposed walls and having an upper surface against which the first leg of the spring is disposed and a lower surface against which a lever stop disposed on the pivotable handle is disposed when the pivotable handle is urged to the stowed position.

* * * * *